US008448270B2

(12) United States Patent
Yang

(10) Patent No.: US 8,448,270 B2
(45) Date of Patent: May 28, 2013

(54) MOVABLE SUPPORT SEAT FOR A SHOWER HEAD

(75) Inventor: Chao-Ta Yang, Taichung (TW)

(73) Assignee: Globe Union Industrial Corp., Taichung (TW)

( * ) Notice: Subject to any disclaimer, the term of this patent is extended or adjusted under 35 U.S.C. 154(b) by 756 days.

(21) Appl. No.: 12/693,953

(22) Filed: Jan. 26, 2010

(65) Prior Publication Data

US 2011/0179566 A1 Jul. 28, 2011

(51) Int. Cl.
*E03C 1/06* (2006.01)
*F16M 13/02* (2006.01)

(52) U.S. Cl.
USPC ..... 4/567; 4/605; 4/615; 4/570; 4/604; 4/568; 248/222.11; 248/222.12; 248/230.1; 248/316.1; 248/218.4; 248/230.4

(58) Field of Classification Search
USPC ..... 4/570, 601, 605, 615; 248/230.3, 248/218.4, 230.2, 219.1, 222.12, 230.4, 230.8, 248/231.4
See application file for complete search history.

(56) References Cited

U.S. PATENT DOCUMENTS 6,473,916 B2 * 11/2002 Schøidt ..... 4/567
7,708,736 B2 * 5/2010 Mullaney ..... 606/54

* cited by examiner

*Primary Examiner* — Gregory Huson
*Assistant Examiner* — Christine Skubinna

(57) ABSTRACT

A movable support seat for a shower head includes a holding member to receive a removable shower head; a moving member moving vertically along a post and being used to receive the holding member; the moving member having a body disposed to the post, at least one movable retaining paw axially fixed to the body, a resilient element installed to a predetermined position of the retaining paw to actuate the paw portion to elastically engage with a peripheral outer surface of the post and to position the moving member to the post such that when a pressing portion of the retaining paw is pressed, first or second abutting wall of the retaining paw disengages from the post so that the moving member is adjusted freely on the post.

17 Claims, 10 Drawing Sheets

MOVABLE SUPPORT SEAT FOR A SHOWER HEAD

BACKGROUND OF THE INVENTION

1. Field of the Invention

The present invention relates to a movable support seat for a shower head that water spraying range of the shower head is adjusted freely based on different demands.

2. Description of the Prior Art

Conventional shower head is installed to a wall of a bathe room to spray water in a fixed direction, and a water spraying direction of a hand-held shower head is controlled manually. However, a support seat of the shower head is positioned at a fixed height that can not adjust its positioning height freely. Therefore, an improved support seat of the shower head is developed to adjust a height of the support seat on a post freely.

Such a movable support seat includes a rotary handle disposed on one end thereof to control the support seat to engage with or disengage from the post, thus enabling to move the support seat on a post freely, the support seat further includes a holding member to receive the shower head mounted on another end thereof, and the post is inserted through the support seat. Because the rotary handle is installed to the support seat, an enough installing space is required that can not be saved economically. Furthermore, a use has to control the support seat by rotating the rotary handle, having an inconvenient operation.

A slide bar assembly disclosed in Publication No. 20070245483 comprises a slide bar to support a bracket assembly that is suitable to retain a handheld showerhead. A brake assembly releasably couples the bracket assembly to the slide bar via a user-actuated trigger in order allow the user to adjust the height of the showerhead by pressing the trigger. The slide bar assembly further includes a wall mounting assembly that is configured to connect the slide bar to the shower wall.

However, an operating space is limited and the bracket assembly can not be positioned to the slide bar tightly.

The present invention has arisen to mitigate and/or obviate the afore-described disadvantages.

SUMMARY OF THE INVENTION

The primary object of the present invention is to provide a movable support seat for a shower head which is capable of overcoming the shortcomings of the conventional plastic outlet pipe and making process thereof.

Further object of the present invention is to provide a movable support seat for a shower head that is operated with saving labor and space.

Another object of the present invention is to provide a movable support seat for a shower head that can prevent from abrasion and prolong service life, and water spraying range of the shower head can be adjusted freely based on different demands.

A movable support seat for a shower head in accordance with a first embodiment of the present invention comprises:

a holding member to receive a removable shower head;

a moving member moving vertically along a post and being used to receive the holding member and including:

a body having a chamber, two first ends, two second ends, and peripheral sides between the first and the second ends; the chamber including a first opening disposed on the first end, and including two side openings mounted between the peripheral sides to communicate with the first opening so as to form a U-shaped gap; the chamber also including a first limiting arm and a second limiting arm arranged on an upper and a lower ends thereof individually, and the first and the second limiting arms including a first defining hole and a second defining hole fixed thereon respectively to insert the post; the holding member being installed to the second end of the body;

two movable retaining paw axially disposed to the first opening and the side openings and including a paw portion and a pressing portion; the paw portion including a concavely arcuate first abutting wall retained therein to match with the post so as to engage with the post and disengage from the post by pressing the pressing portion;

a first resilient element installed to a predetermined position of the retaining paw to actuate the paw portion to elastically engage with a peripheral outer surface of the post.

A movable support seat for a shower head in accordance with a second embodiment of the present invention comprises:

a holding member to receive a removable shower head;

a moving member moving vertically along a post and being used to receive the holding member and including:

a body having a chamber, two first ends, two second ends, a first peripheral side and a second peripheral side; between the second peripheral side and the first end is defined a membrane, the first peripheral side including a side opening disposed thereon, and the first end including a first opening mounted thereon; the chamber also including a first limiting arm and a second limiting arm arranged on an upper and a lower ends thereof individually, and the first and the second limiting arms including a first defining hole and a second defining hole fixed thereon respectively to insert the post; the membrane including a concavely arcuate second abutting wall defined therein, and the second abutting wall matching with the post; the holding member being installed to the second end of the body;

a movable retaining paw movably disposed to the first opening and the side opening and including a paw portion and a pressing portion; the second abutting wall of the membrane matching with the post, such that the first abutting wall of the paw portion of the retaining paw contacts with the post elastically, and the peripheral outer surface of the post abuts against the second abutting wall of the membrane so as to position the moving member at a predetermined height of the post.

a second resilient element inserted between the membrane and the retaining paw to actuate the paw portion of the retaining paw to elastically engage with a peripheral outer surface of the post.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
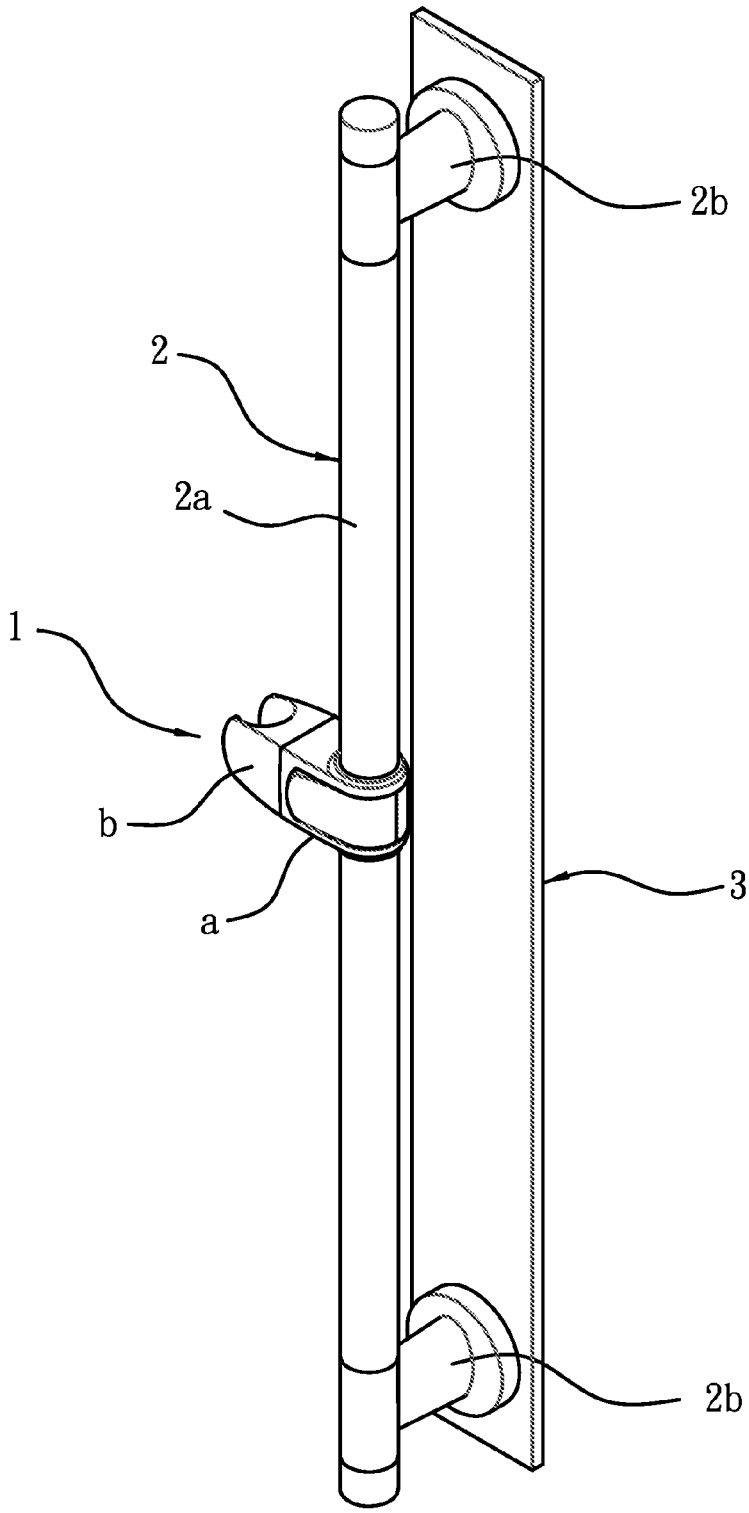
FIG. 1 is a perspective view showing a movable support seat for a shower head being positioned to a post according to a first embodiment of the present invention.

Referring to FIG. 1, a movable support seat 1 for a shower head according to a first embodiment of the present invention is retained to a post 2*a* of a rod assembly 2, and the post 2*a* is fixed to a wall 3 of a bath room by using two positioning elements 2*b* disposed on an upper and a lower ends of the post 2*a*, the structure of the rod assembly 2 is well-known, therefore further remarks are omitted, wherein the support seat 1 comprises a moving member a and a holding member b.

Figure 2:
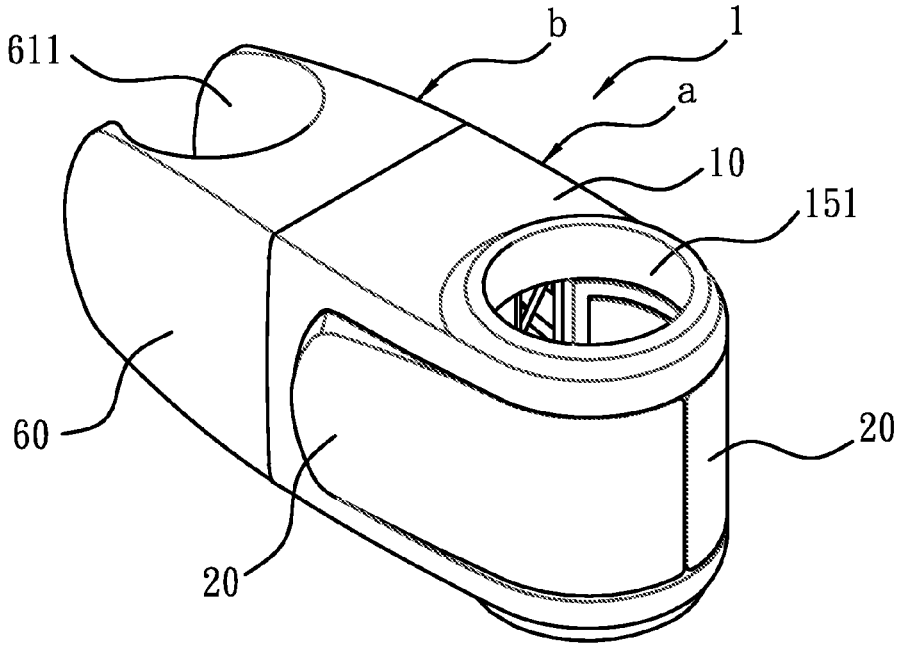
FIG. 2 is a perspective view showing the assembly of the movable support seat for the shower head according to the first embodiment of the present invention.
Figure 6:
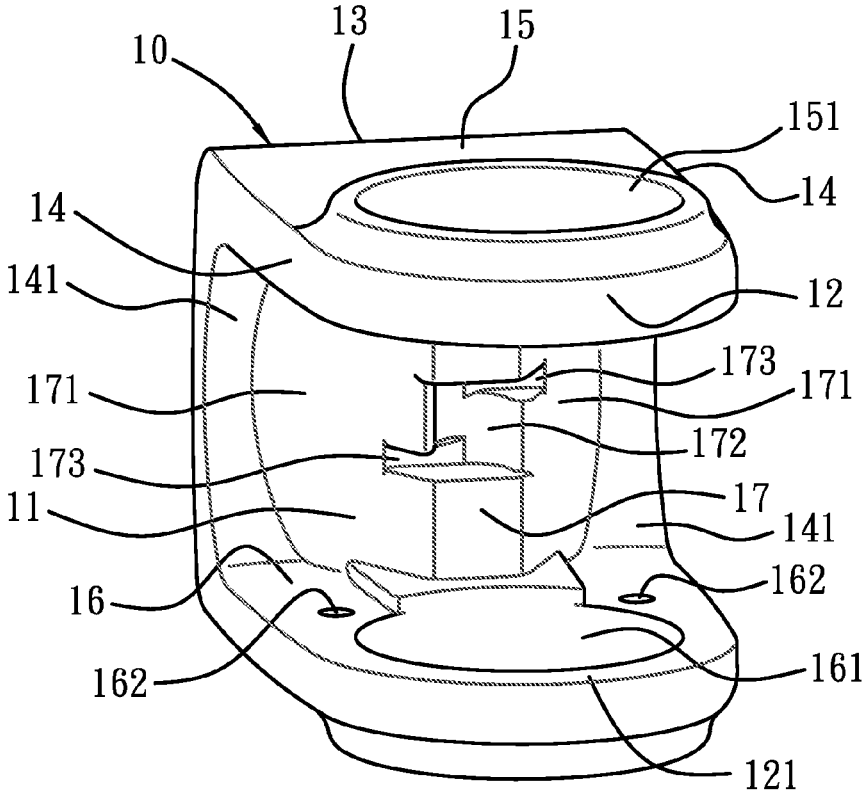
FIG. 6 is a perspective view showing the assembly of a body according to the first embodiment of the present invention.
Figure 3:
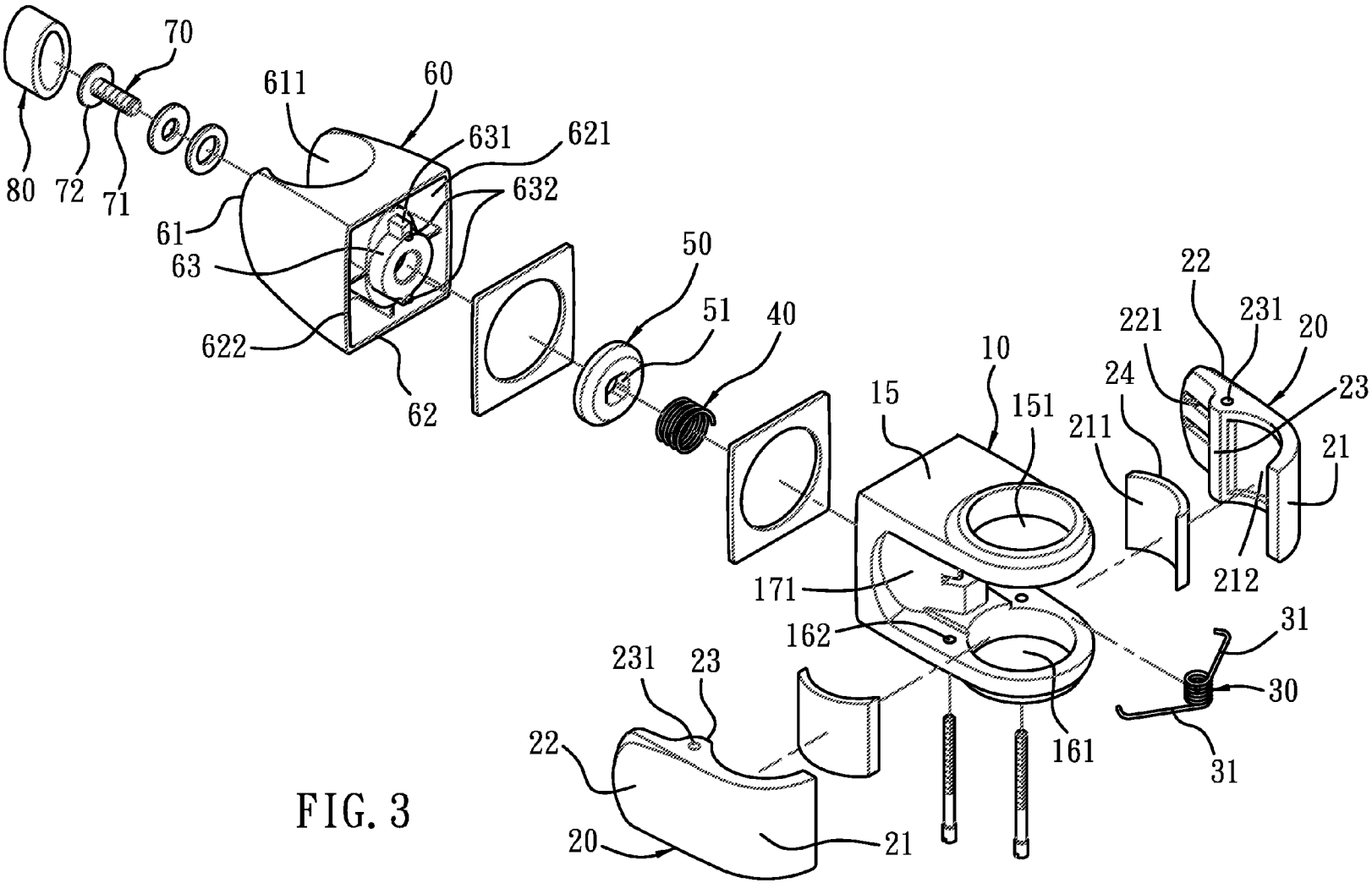
FIG. 3 is a perspective view showing the exploded components of the movable support seat for the shower head according to the first embodiment of the present invention.
Figure 4:
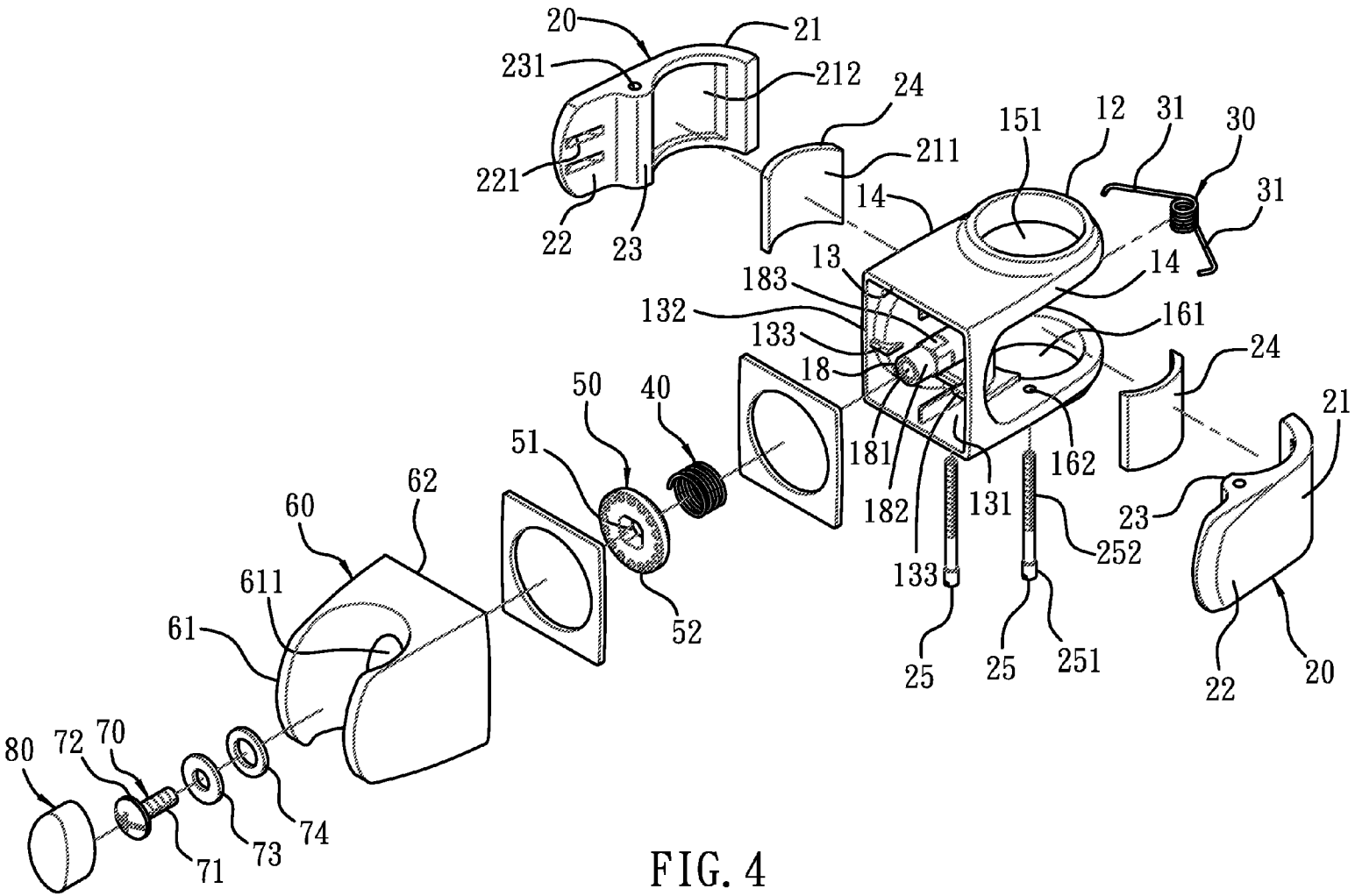
FIG. 4 is another perspective view showing the exploded components of the movable support seat for the shower head according to the first embodiment of the present invention.
Figure 7:
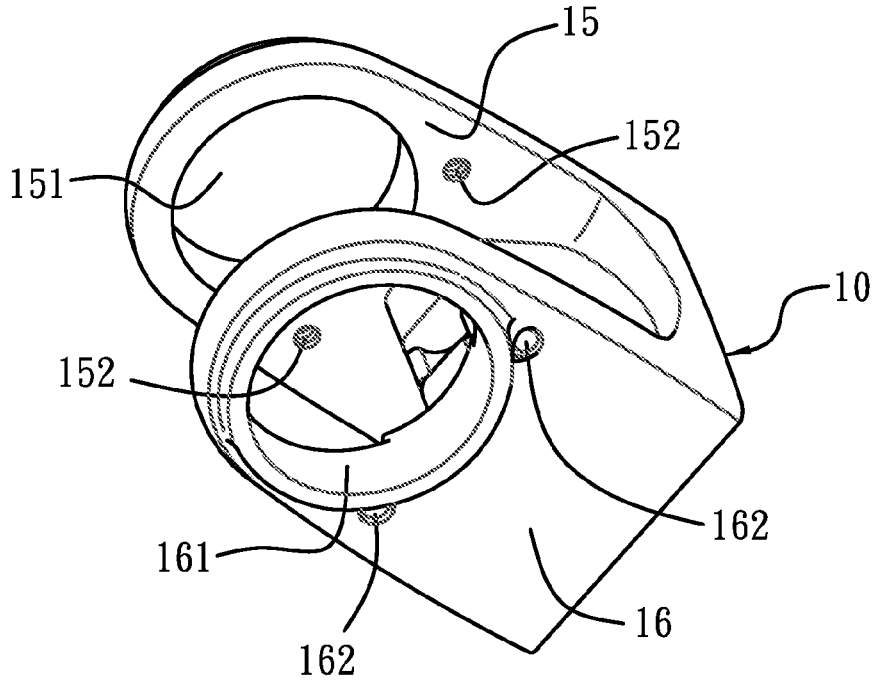
FIG. 7 is a bottom perspective view showing the assembly of the body according to the first embodiment of the present invention.

The moving member a as shown in FIGS. 2-4 moves vertically along the post 2*a* and includes a body 10, two movable retaining paws 20, and a first resilient element 30, wherein the body 10 as illustrated in FIGS. 6 and 7 includes a chamber 11, two first ends 12, two second ends 13, and peripheral sides 14 between the first and the second ends 13; the chamber 11 includes two first openings 121 disposed on the first ends 12 respectively, and includes two side openings 141 mounted between the peripheral sides 14 to communicate with the first openings 121 so as to form a U-shaped gap; the chamber 11 also includes a first limiting arm 15 and a second limiting arm 16 arranged on an upper and a lower ends thereof individually, and the first and the second limiting arms 15, 16 include a first defining hole 151 and a second defining hole 161 fixed thereon respectively to insert the post 2*a*. In this embodiment, the first and second defining holes 151, 161 are a closed hole.

The body 10 includes two first screw bores 152 formed on a bottom surface of the first limiting arm 15, and includes two first apertures 162 arranged on a top surface of the second limiting arm 16, includes an integrally formed projection 17 defined in the chamber 11 thereof as shown in FIG. 6, and the projection 17 includes two limit fringes 171 disposed on two sides thereof individually, and includes a receiving groove 172 mounted therein, the receiving groove 172 includes two cutouts 173 fixed on two opposite sides of an upper and a lower ends thereof individually.

Figure 5:
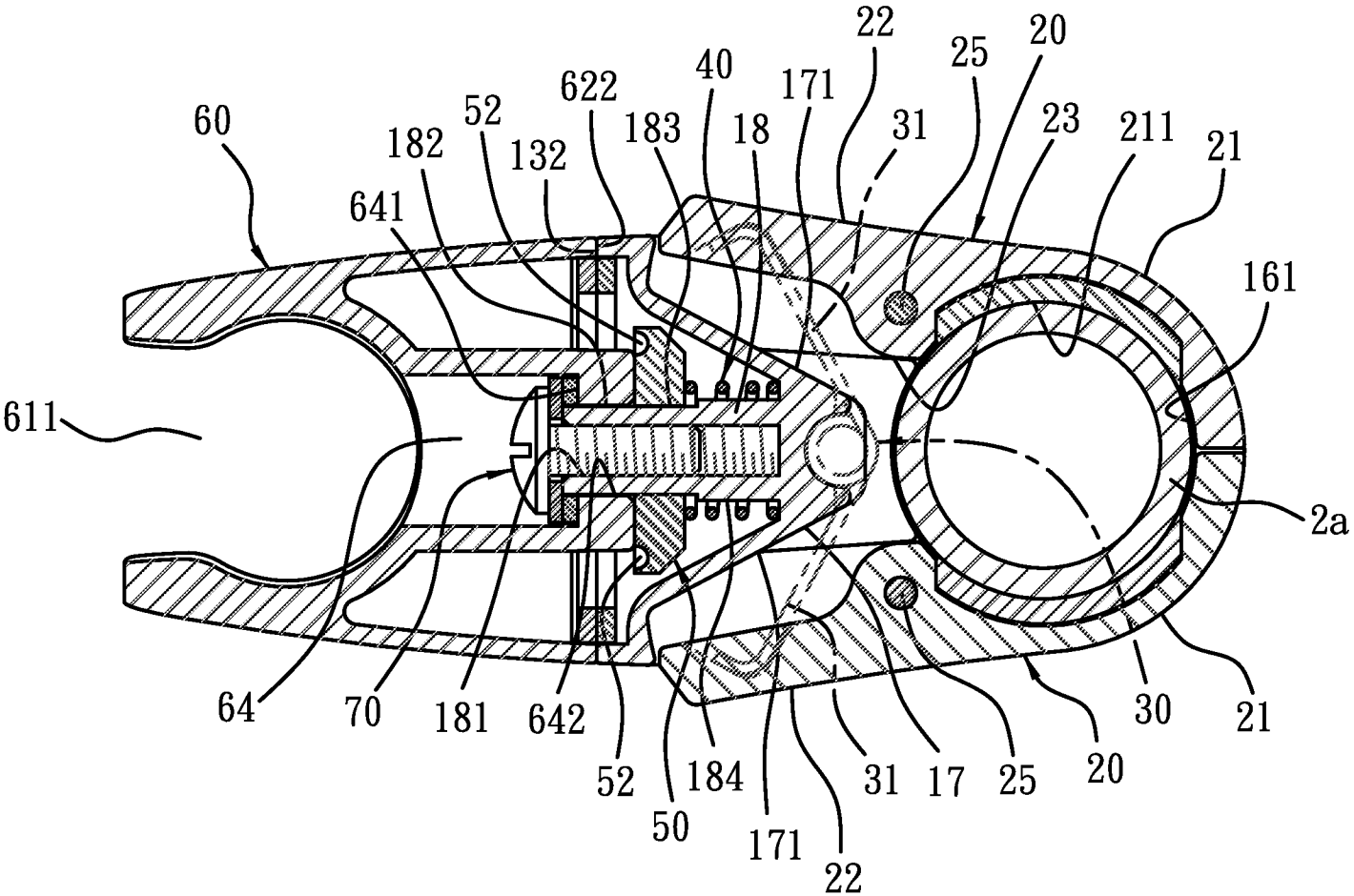
FIG. 5 is a cross sectional view showing the assembly of the movable support seat for the shower head according to the first embodiment of the present invention.

Referring to FIG. 4, the second end 13 of the body 10 includes a recess 131 formed therein, a first outer wall 132 formed around the recess 131, and a fixing peg 18 fixed in the recess 131; the recess 131 includes two stators 133 extending from two sides thereof respectively, and the fixing peg 18 includes an orifice 181 disposed therein, a circular fence 182 arranged around an outer side thereof as shown in FIG. 5, a cut rim 183 disposed on a central section thereof, and an engaging periphery 184 formed on an inner section thereof.

The retaining paw 20 includes a paw portion 21, a pressing portion 22, and an axial connecting portion 23 between the paw portion 21 and the pressing portion 22; the retaining paws 20 are axially disposed to the side openings 141 and the first openings 121 of the body 10 by using the axial connecting portions 23, and a distal end of the paw portion 21 is in response to a central portion of the first opening 121; the paw portion 21 includes a concavely arcuate first abutting wall 211 retained therein to match with the post 2*a*. In this embodiment, the first abutting wall 211 is an internal side surface of a first elastic block 24, and the first elastic block 24 is retained to a slot 212 which is formed in the paw portion 21.

The pressing portion 22 of the retaining paw 20 includes two indentions 221 arranged therein.

The axial connecting portion 23 of the retaining paw 20 includes a through pore 231 vertically mounted therein to insert a first shaft 25, and the first shaft 25 includes a head end 251 fixed on a bottom side thereof to be rotated, and includes outer threads 252 formed on a top side thereof so that the first shaft 25 inserts from the first aperture 162 of the second limiting arm 16 of the body 10 to screw with the first screw bore 152 of the first limiting arm 15 through the through pore 231 of the retaining paw 20 so as to pivot the retaining paw 20.

The first resilient element 30 is a torsion spring to be installed to the receiving groove 172 of the projection 17 of the body 10, and two free ends 31 of the first resilient element 30 insert through the cutout 173 of the receiving groove 172 to engage with the indentions 221 of the pressing portion 22 such that the first resilient element 30 actuates the paw portion to elastically engage with a peripheral outer surface of the post 2*a*, thus positioning the post 2*a* at a predetermined height.

Figure 10:
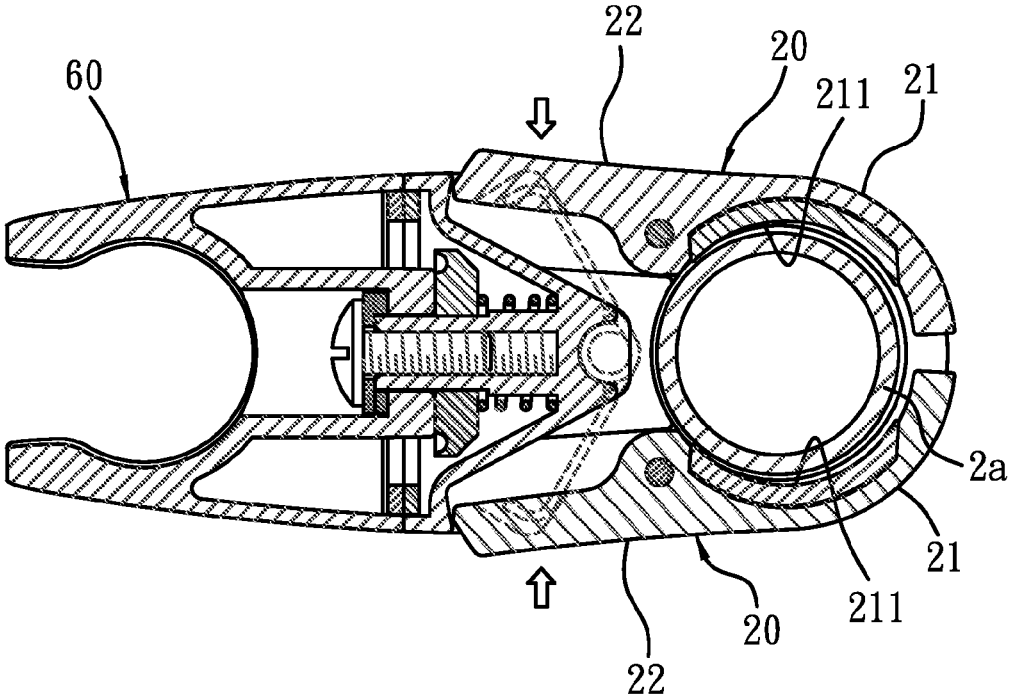
FIG. 10 is a cross sectional view showing the operation of the movable support seat for the shower head according to the first embodiment of the present invention.

As shown in FIG. 10, when the pressing portion 22 of the retaining paw 20 is pressed, the paw portion 21 rotates outward so that the first abutting wall 211 disengages from the post 2*a* to move the moving member a along the post 2*a* vertically, and then the moving member a is fixed.

The limit fringes 171 of the projection 17 of the body 10 are used to engage with the pressing portion 22 of the retaining paw 20, so that the pressing portion 22 of the retaining paw 20 is pressed to rotate inward and then to engage with the limit fringes 171 of the projection 17 of the body 10 properly.

The holding member b as shown in FIGS. 2-4 is installed to the second end 13 of the body 10 to receive a removable shower head, and includes a compression spring 40, a locating disc 50, a base 60, a locking element 70, and a sleeve member 80, wherein the compression spring 40 is inserted to the engaging periphery 184 of the fixing peg 18 of the body 10.

The locating disc 50 includes an inlet 51 arranged on a central portion thereof to engage with the cut rim 183 of the fixing peg 18 so as to limit the locating disc 50 to rotate, and the locating disc 50 includes a plurality of vents 52 circularly arranged around an outer side thereof.

Figure 8:
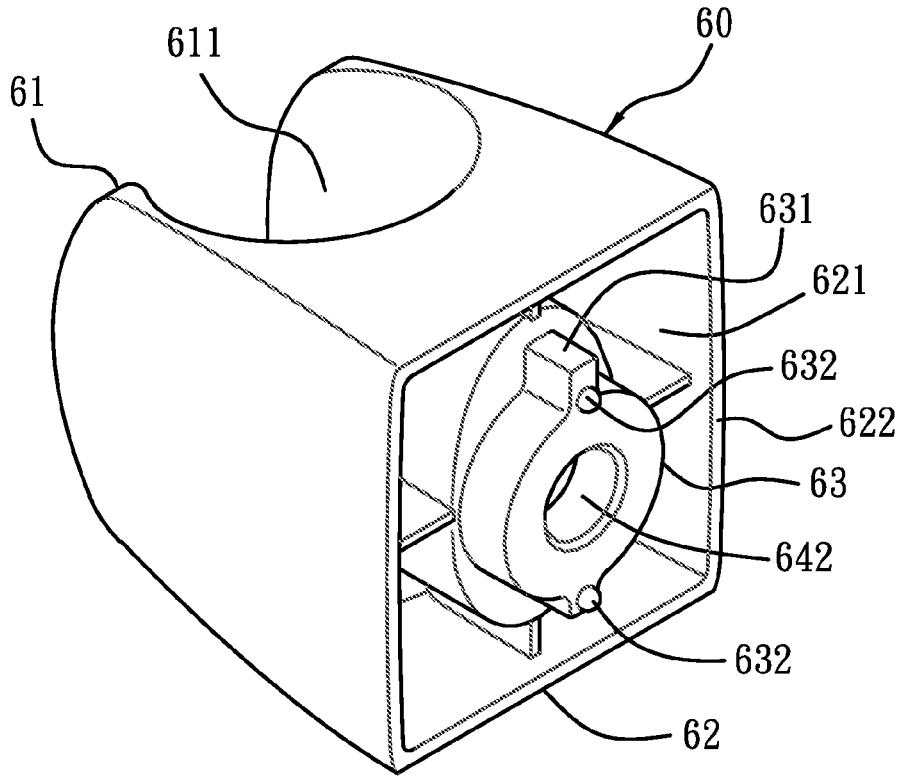
FIG. 8 is a perspective view showing the assembly of a base according to the first embodiment of the present invention.
Figure 9:
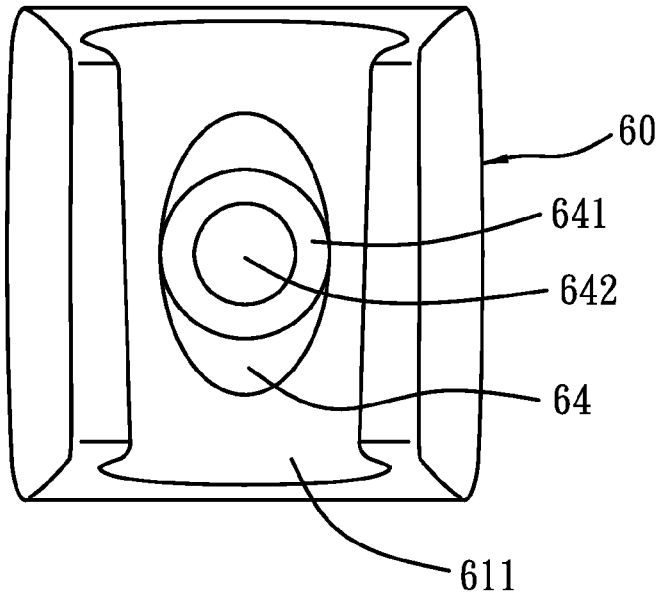
FIG. 9 is a side plan view showing a notch of the base according to the first embodiment of the present invention.

The base 60 as illustrated in FIGS. 8 and 9 includes a first edge 61 and a second edge 62 relative to the second end 13 of the body 10; the first edge 61 includes a notch 611 to retain the shower head; and the second edge 62 includes a dent 621 disposed thereon and an integrally formed raised border 63 mounted on a center thereof, the raised border 63 includes two bosses 632 extending therefrom to rotate with the base 60 so as to engage with the vents 52 of the locating disc 50. The raised border 63 further includes a rotor 631 formed on a top surface thereof to be limited to rotate within 180 degree of an upper space between the stators 133 of the body 10 so that the shower head is limited to rotate within 90 degrees in clockwise and anti-clockwise directions.

The dent 621 includes a second outer wall 622 arranged therearound.

The notch 611 of the base 60 includes an oval trench 64 disposed on a central portion thereof as illustrated in FIGS. 4 and 5, and the trench 64 includes a coupling fringe 641 disposed on a central portion thereof, the coupling fringe 641 includes a second aperture 642 mounted on a central portion thereof, wherein the fence 182 of the fixing peg 18 of the body 10 allows to insert through the second aperture 642.

The locking element 70 is a bolt and includes a pillar segment 71 to screw with the orifice 181 of the fixing peg 18 of the body 10 from the notch 611 of the base 60 so as to abut a disk segment 72 of the locking element 70 against the coupling fringe 641 tightly, such that the second outer wall 622 of the first edge 61 of the base 60 abuts against the first outer wall 132 of the second end 13 of the body 10 and is biased against by the compression spring 40 by using the locating disc 50 so that the vents 52 engage with the bosses 632 to rotatably position the holding member b at a predetermined angle.

To prevent water from permeating to the locking element 70, the locking element 70 further includes a first and a second closing pads 73, 74, wherein the first closing pad 73 is inserted to the locking element 70 so as to be retained between the disk segment 72 and the fixing peg 18, and the second closing pad 74 is inserted to the fence 182 of the fixing peg 18 so as to be retained between the coupling fringe 641 and the first closing pad 73.

A flexible sleeve member 80 is engaged to the trench 64, and includes an arcuate surface extending out of the trench 64 to be engaged to the notch 611.

With reference to FIG. 1, the support seat 1 is positioned and retained to the post 2*a* of the rod assembly 2 securely by ways of the retaining paw 20 of the moving member a as shown in FIG. 5, so that the moving member a and the holding member b are fixed at a predetermined height of the post 2*a*. Because the positioning height of the support seat 1 influences the shower head, water spraying height and range are not suitable for any requirement, therefore user can adjustably move the moving member a along the post 2*a* as shown in FIG. 10 by pressing the pressing portions 22 of the retaining paws 20. Thereafter, the pressing portions 22 are released to return original positioning state, thereby operating the movable support seat easily.

Figure 11:
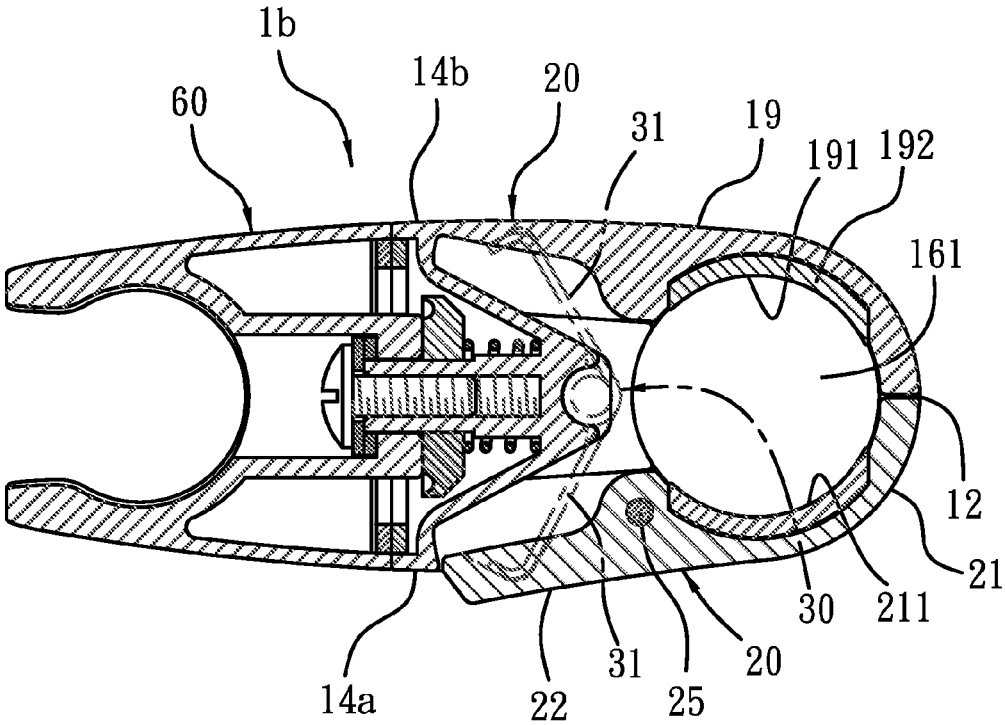
FIG. 11 is a cross sectional view showing the assembly of a movable support seat for a shower head according to a second embodiment of the present invention.

Referring to FIG. 11, a difference of a support seat 1*b* according to a second embodiment of the present invention from that of the first embodiment includes a membrane 19, and a first peripheral side 14*a* and a second peripheral side 14*b*, the first peripheral side 14*a* includes a side opening 141, and between the second peripheral side 14*b* and the first end 12 is defined the membrane 19. The membrane 19 is comprised of an integrally formed body 10 or an independent component to close the second peripheral side 14*b* and the first end 12.

To retain the post 2*a* securely, the membrane 19 includes a concavely arcuate second abutting wall 191 defined therein, and the second abutting wall 191 includes a second elastic block 192 formed therein and extendedly inserts to the first defining hole 151 or the second defining hole 161 to match with the post 2*a*.

Thereby, the first abutting wall 211 of the paw portion 21 of the retaining paw 20 contacts with the post 2*a* elastically, and the peripheral outer surface of the post 2*a* abuts against the second abutting wall 191 of the membrane 19 so as to position the moving member a at a predetermined height of the post 2*a*.

When the retaining paw 20 of the pressing portion 22 is pressed by the user, the paw portion 21 rotates outward so that the first abutting wall 211 disengages from the post 2*a*, and then the post 2*a* disengages from the second abutting wall 191 of the membrane 19 so as to move the support seat 1 along the post 2*a*, and then the support seat 1 is fixed on the post 2*a*.

Figure 12:
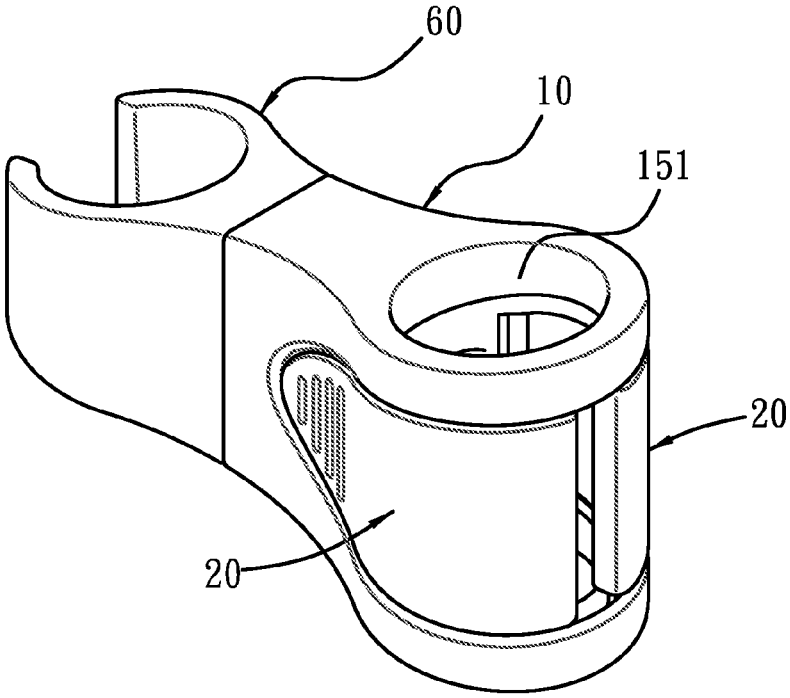
FIG. 12 is a perspective view showing the assembly of a movable support seat for a shower head according to a third embodiment of the present invention.
Figure 13:
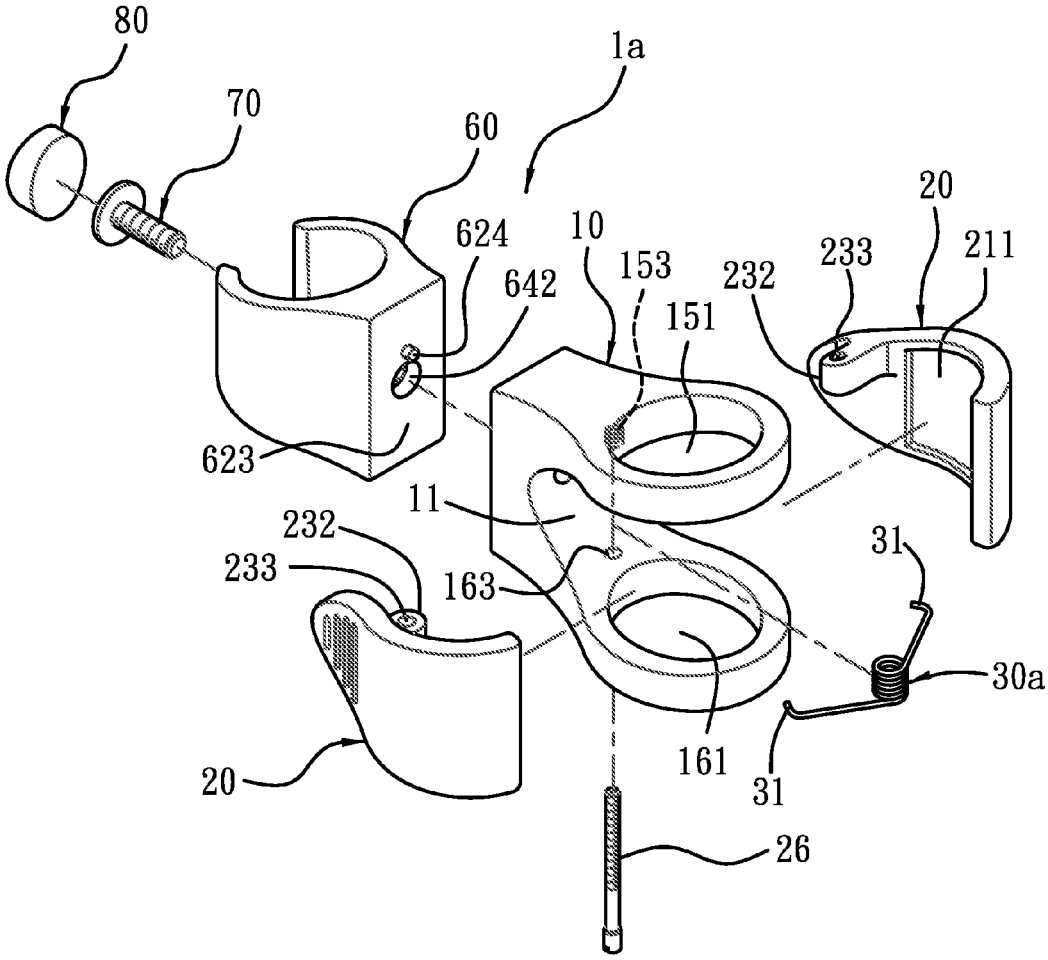
FIG. 13 is a perspective view showing the exploded components of the movable support seat for the shower head according to the third embodiment of the present invention.
Figure 14:
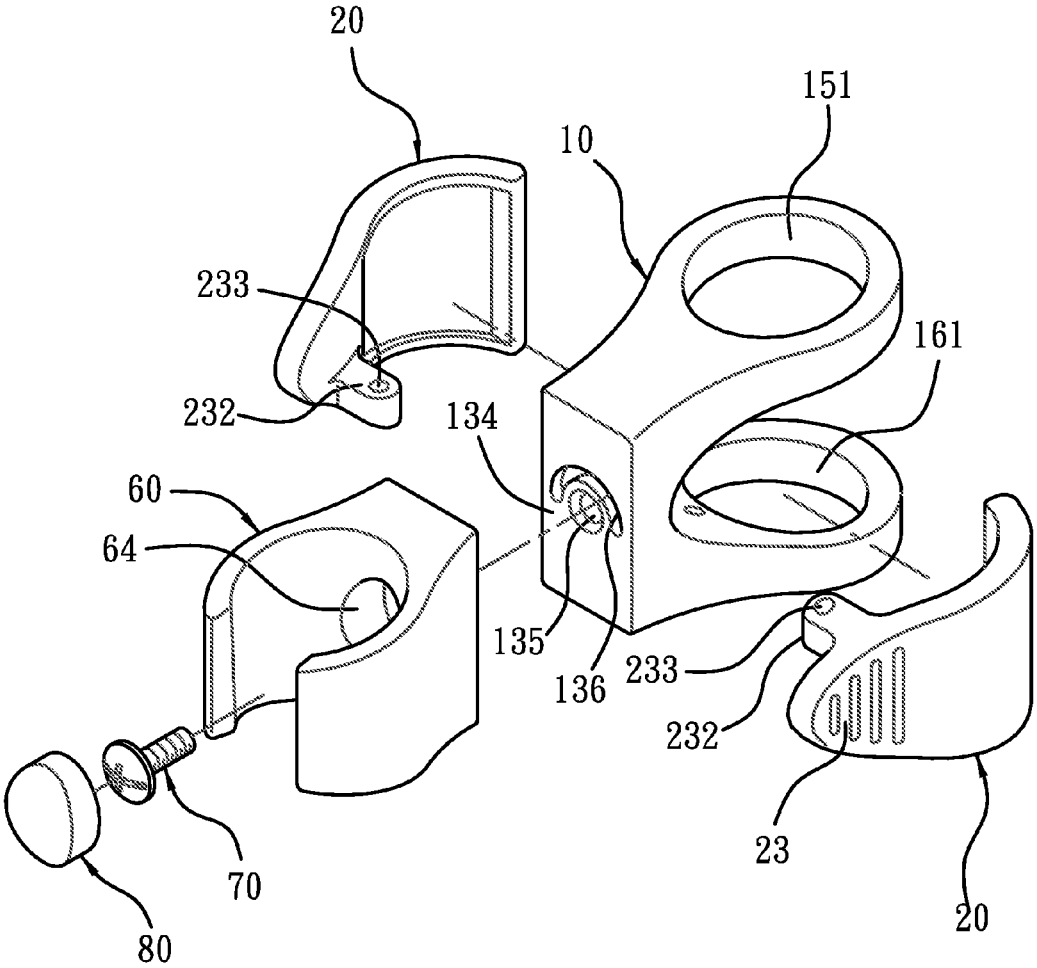
FIG. 14 is another perspective view showing the exploded components of the movable support seat for the shower head according to the third embodiment of the present invention.

As shown in FIGS. 12-14, a difference of a support seat 1*a* according to a third embodiment of the present invention from that of the first embodiment includes a second shaft 26 to replace the two first shafts 25 of the first embodiment, and the axial connecting portions 23 include two tabs 232 formed on an upper and a lower edges of the retaining paw 20 respectively, and each tab 232 includes an ventilation 233 disposed thereon, such that the second shaft 26 is inserted from a third aperture 163 of the second limiting arm 16 to screw with a second screw bore 153 via the ventilations 233 of the tabs 232, thus axially positioning the retaining paw 20. Thereby, a second resilient element 30*a* is used to be inserted to the second shaft 26, and the second resilient element 30*a* is a torsion spring such that the free ends 31 are retained to the pressing portions 22 of the retaining paws 20, and then the paw portions 21 engage with the post 2*a*. In addition, the second end 13 of the body 10 is changed into a closed first cliff 134, and the first cliff 134 includes a third screw bore 135 arranged thereon, includes an arc-shaped ditch 136 above the third screw bore 135, the second edge 62 of the base 60 is changed into a closed second cliff 623 to communicate with the second aperture 642, and a confining pin 624 extends above the second aperture 642 to be inserted to the ditch 136 of the body 10 so that the base 60 is limited to rotate within 180 degrees, and the locking element 70 inserts through the second aperture 642 to screw with the third screw bore 135, thus positioning the base 60 at a predetermined angle. It is to be noted that the first and the second defining holes 151, 161 can also be a C-shaped hole to limit the post 2*a*, and the torsion spring allows to be replaced by a U-shaped resilient piece. For example, the U-shaped resilient piece is installed to the paw portion 21 of the retaining paw 20 so that the first abutting wall 211 of the paw portion 21 moves inward to engage the post 2*a*, and when the pressing portion 22 is pressed, the paw portion 21 rotates outward to disengage from the post 2*a*.

The two first shafts 25 or the second shaft 26 of the retaining paw 20 can be replaced by a slidable guiding structure as well. For example, the slidable guiding structure is defined between the retaining paw 20 and the first limiting arm 15 and between the retaining paw 20 and the second limiting arm 16, and an acting portion of the free ends of the torsion spring (e.g., an inner side of the pressing portion 22) is changed into an inner rim of the pressing portion 22 so that an elastic torque pushes the retaining paw 20 to move outward and slide along the slidable guiding structure, hence the first abutting wall 211 of the paw portion 21 engages with the post 2*a*, the slidable guiding structure includes a slidable block and a sliding groove, and the first abutting wall 211 of the paw portion 21 slides toward the post 2*a* to generate a retaining effect. On contrary, when the slidable guiding structure is used in the movable support seat, the pressing portion 22 of the retaining paw 20 is pressed to force the retaining paw 20 to slide inward so that the paw portion 21 disengages from the post 2*a*.

Furthermore, the side opening 141 and the first opening 121 are closed by the retaining paw 20 when the retaining paw 20 is in a retaining state, accordingly a complete plane is formed between the body 10 and the retaining paw 20 to prevent water from permeating and to obtain aesthetics appearance.

While we have shown and described various embodiments in accordance with the present invention, it is clear to those skilled in the art that further embodiments may be made without departing from the scope of the present invention.

What is claimed is:

1. A movable support seat for a shower head comprising:

a holding member to receive a removable shower head;

a moving member moving vertically along a post and being used to receive the holding member and including:

a body having a chamber, two first ends, two second ends, and peripheral sides between the first and the second ends; the chamber including a first opening disposed on the first end, and including two side openings mounted between the peripheral sides to communicate with the first opening so as to form a U-shaped gap; the chamber also including a first limiting arm and a second limiting arm arranged on an upper and a lower ends thereof individually, and the first and the second limiting aims including a first defining hole and a second defining hole fixed thereon respectively to insert the post; the holding member being installed to the second end of the body;

two movable retaining paws axially disposed to the first opening and the side openings and including a paw portion and a pressing portion; the paw portion including a concavely arcuate first abutting wall retained therein to match with the post so as to engage with the post and disengage from the post by pressing the pressing portion;

a first resilient element installed to a predetermined position of the retaining paw to actuate the paw portion to elastically engage with a peripheral outer surface of the post;

wherein the first abutting wall is an internal side surface of a first elastic block, and the first elastic block is retained to a slot which is formed in the paw portion.

2. The movable support seat for the shower head as claimed in claim 1, wherein the retaining paw further includes an axial connecting portion located between the paw portion and the pressing portion so that the retaining paws are axially disposed to the side openings and the first openings of the body by using the axial connecting portions.

3. The movable support seat for the shower head as claimed in claim 2, wherein between the first and the second limiting arms of the body are fixed two first shafts; and the axial connecting portions of the retaining paws are axially positioned by using the first shafts to form two independent rotating fulcrums.

4. The movable support seat for the shower head as claimed in claim 2, wherein the body includes an integrally formed projection defined in the chamber thereof, and the projection includes two limit fringes disposed on two sides thereof individually so that the pressing portion of the retaining paw is pressed to rotate inward and then to engage with the limit fringes of the projection properly.

5. The movable support seat for the shower head as claimed in claim 4, wherein the projection includes a receiving groove mounted therein, the receiving groove includes two cutouts fixed on two opposite sides of an upper and a lower ends thereof individually; the first resilient element is a torsion spring to be installed to the receiving groove of the projection, and two free ends of the first resilient element insert through the cutout of the receiving groove to engage with the pressing portion of the retaining paw.

6. The movable support seat for the shower head as claimed in claim 2, wherein a second shaft is defined between the first and the second limiting arms of the body, and the axial connecting portions of the retaining paw include two tabs, such that the second shaft is inserted through the tabs to axially position the retaining paw, forming a single rotating fulcrum.

7. The movable support seat for the shower head as claimed in claim 1, wherein the second end of the body includes a recess formed therein and a fixing peg fixed in the recess; the holding member includes a compression spring, a locating disc, a base, and a locking element, the compression spring and the locating disc are inserted to the fixing peg, and the locating disc includes a plurality of vents circularly arranged around an outer side thereof; the base includes a first edge and a second edge relative to the second end; the first edge includes a notch to retain the shower head; and the second edge includes a dent disposed thereon and at least one boss extending therefrom to rotate with the base so as to engage with the vents of the locating disc; the locking element screws with the fixing peg from the notch of the base so that the first edge of the base engages with the second end of the body, and the locating disc is biased against by the compression spring so that the vents engage with the bosses to rotatably position the holding member at a predetermined angle.

8. The movable support seat for the shower head as claimed in claim 7, wherein the recess of the body includes two stators extending from two sides thereof respectively, and the second edge includes an integrally formed raised border mounted on a center thereof, the raised border includes a rotor formed on a top surface thereof to be limited to rotate within 180 degree of an upper space between the stators of the body so that the shower head is limited to rotate within 90 degrees in clockwise and anti-clockwise directions.

9. The movable support seat for the shower head as claimed in claim 7, wherein the notch of the base includes an oval trench disposed on a central portion thereof, and the trench includes a coupling fringe disposed on a central portion thereof, the coupling fringe includes a second aperture mounted on a central portion thereof; the locking element is a bolt to screw with the fixing peg via the second aperture so as to abut a disk segment of the locking element against the coupling fringe tightly; a flexible sleeve member is engaged to the trench, and includes an arcuate surface extending out of the trench to be engaged to the notch.

10. The movable support seat for the shower head as claimed in claim 1, wherein the side opening and the first opening are closed by the retaining paw when the retaining paw is in a retaining state.

11. A movable support seat for a shower head comprising:

a holding member to receive a removable shower head;

a moving member moving vertically along a post and being used to receive the holding member and including:

a body having a chamber, two first ends, two second ends, a first peripheral side and a second peripheral side; between the second peripheral side and the first end is defined a membrane, the first peripheral side including a side opening disposed thereon, and the first end including a first opening mounted thereon; the chamber also including a first limiting arm and a second limiting arm arranged on an upper and a lower ends thereof individually, and the first and the second limiting arms including a first defining hole and a second defining hole fixed thereon respectively to insert the post; the membrane including a concavely arcuate second abutting wall defined therein, and the second abutting wall matching with the post; the holding member being installed to the second end of the body;

a movable retaining paw movably disposed to the first opening and the side opening and including a paw portion and a pressing portion; the second abutting wall of the membrane matching with the post, such that the first abutting wall of the paw portion of the retaining paw contacts with the post elastically, and the peripheral outer surface of the post abuts against the second abutting wall of the membrane so as to position the moving member at a predetermined height of the post;

a second resilient element inserted between the membrane and the retaining paw to actuate the paw portion of the retaining paw to elastically engage with a peripheral outer surface of the post;

wherein the second abutting wall includes a second elastic block formed therein.

12. The movable support seat for the shower head as claimed in claim 11, wherein the membrane is comprised of the integrally formed body.

13. The movable support seat for the shower head as claimed in claim 11, wherein the membrane is comprised of an independent component to close the second peripheral side and the first end.

14. The movable support seat for the shower head as claimed in claim 11, wherein the retaining paw further includes an axial connecting portion located between the paw portion and the pressing portion so that the retaining paw is axially disposed to the side openings and the first openings of the body by using the axial connecting portion.

15. The movable support seat for the shower head as claimed in claim 14, wherein a second shaft is inserted to the first and second limiting arms to axially position the retaining paw.

16. The movable support seat for the shower head as claimed in claim 11, wherein the body includes an integrally formed projection defined in the chamber thereof, and the projection includes two limit fringes disposed on two sides thereof individually so that the pressing portion of the retaining paw is pressed to rotate inward and then to engage with the limit fringes of the projection properly.

17. The movable support seat for the shower head as claimed in claim 11, wherein the side opening and the first opening are closed by the retaining paw when the retaining paw is in a retaining state.

* * * * *